United States Patent [19]

Razgildeev et al.

[11] 3,995,908

[45] Dec. 7, 1976

[54] HYDRAULIC-MECHANICAL COAL MINING COMBINE

[76] Inventors: Gennady Innokentievich Razgildeev, ulitsa Michurina, 5, kv. 28, Novokuznetsk Kemerovskoi oblasti; Boris Yakovlevich Ekber, ulitsa Zoologicheskaya, 3, kv. 73, Moscow; Petr Ipatovich Jurin, ulitsa Chernomorskaya, 2, kv. 12, Novokuznetsk Kemerovskoi oblasti; Vladislav Markovich Kernichansky, ulitsa Klimenko, 32, kv. 3, Novokuznetsk Kemerovskoi oblasti; Alexandr Semenovich Gorbachev, prospekt Pionersky, 25, kv. 46, Novokuznetsk Kemerovskoi oblasti; Grigory Markovich Timoshenko, bulvar Pushkina, 27, kv. 33, Donetsk; Stanislav Antonovich Lenenko, ulitsa Krasnoflotskaya, 76, kv. 12, Donetsk; Valery Dmitrievich Namleev, prospekt Ilicha, 9, kv. 51, Donetsk, all of U.S.S.R.

[22] Filed: Dec. 8, 1975

[21] Appl. No.: 638,309

[30] Foreign Application Priority Data

Dec. 9, 1974 U.S.S.R. ..... 2078751

[52] U.S. Cl. ..... 299/56; 299/17; 299/75

[51] Int. Cl.[2] ..... E21C 25/60

[58] Field of Search ..... 299/17, 56, 57, 75, 299/81

[56] References Cited

UNITED STATES PATENTS

| | | | |
|---|---|---|---|
| 3,809,318 | 5/1974 | Yamamoto | 299/17 X |
| 3,813,126 | 5/1974 | Rogne et al. | 299/17 X |

FOREIGN PATENTS OR APPLICATIONS

| | | | |
|---|---|---|---|
| 2,159,268 | 6/1973 | Germany | 299/56 |
| 132,161 | 8/1960 | U.S.S.R. | 299/17 |

*Primary Examiner*—Ernest R. Purser
*Attorney, Agent, or Firm*—Lackenbach, Lilling & Siegel

[57] ABSTRACT

The coal mining combine has a crawler carriage with a driving mechanism supporting a bed plate with a turntable on which an arrow-like actuator with a motor for rotating it and a bit are hinged. The hollow body of the actuator contains a built-in monitor. Hydraulic cylinders which are used for moving the actuator and the monitor's barrel are provided. Manifolds are used for supplying water to the monitor and to the actuator. In accordance with the invention, a channel is made in the supporting bed plate. This channel is a hydraulic shock acceleration tubing whose sections are located one above another in at least two rows. A pneumohydraulic accumulator communicating with the water supply source is connected to the channel's inlet, while an oscillator, included in the network for supplying water to the monitor, is connected to the channel's outlet.

1 Claim, 5 Drawing Figures

HYDRAULIC-MECHANICAL COAL MINING COMBINE

This invention relates to hydraulic-mechanical coal mining combines, namely mining machines with an arrow-like actuator, which are used, preferably, in coal mining, but can also be used for underground workings.

This invention can be used most effectively in hydraulic mining of gently sloping bed deposits, having a thickness of more than 1.8 m, and edge seams having a thickness of more than 4 m, in development workings at a gradient of up to 15°, and in mining coal of different hardness, using mining systems without roofing excavations.

Well known in the art is a hydraulic-mechanical coal mining combine having a crawler carriage with a driving mechanism bearing electric and hydraulic devices for combine control, and a supporting plate with a turntable to which an arrow-like actuator with a motor for rotating it and a bit are hinged. This coal mining combine is provided with hydraulic cylinders for moving the actuator relative to the face. A monitor is fixed to the body of the actuator and its barrel is connected with the hydraulic cylinders for moving it a vertical direction. For supplying water to the monitor and to the actuator the combine is provided with a manifold whose sections are connected with the help of hollow hinges, with the axes of rotation thereof coinciding with geometrical axes of rotation of the turntable and the actuator. This manifold is used for alternating the supply of water under a pressure of up to 10 MPa (hereinafter referred to as "high-pressure water") to the monitor for coal mining from the upper block of untouched ore and the technological pillars and for supplying water under a pressure of up to 5 MPa(hereinafter referred to as "medium-pressure water") to the actuator for its work in making development workings, hydraulic transporting of mined coal from the face, cooling bits and depressing dust in the faces.

In these combines for coal mining from the upper block of untouched ore at the limiting elevation angle of the actuator, the monitor, with the help of guides and sliders provided on the body of the actuator of the combine, is set in such a manner that it can be moved only in a vertical direction (Author's Certificate 420784 issued in the USSR).

Performance of well known hydraulic-mechanical coal mining combines with a supply from a high-pressure mine pipeline is as follows. Initially, coal from development workings is removed by using the actuator, water pressure is reduced from a high level to a medium level with the help of a throttle device and water is supplied to the actuator. When development working is passed completely, the monitor, supplied with water from the second pipeline, is switched on avoiding the throttle device. A high pressure water jet, formed in the monitor channels, carries out coal from the upper block of untouched ore and the technological pillars. An alternating supply of high- and medium-pressure water from the mine pipeline to the coal mining combine is carried out by using a flexible hose or metal folding tubing with link connections.

Flexible hoses during high-pressure water supply to the combine become very stiff, do and not bend and, consequently, the maneuverability of the combine. Moreover, supplying of high-pressure water by using flexible hose is dangerous for maintenance personnel in case of its rupture. Use of a metal link-connected tubing for water supply to the combine reduces maneuverability of the combine, makes coal mining more labour consuming and increases losses of pressure in the system of water supply to the monitor.

During medium-pressure water supply to the combine using the flexible hose offers sufficiently high maneuverability of the combine. However, effective crushing of the upper blocks of the untouched ore and the technological pillars by the water jet, formed in the barrel of the monitor, is not provided.

The main disadvantages of the well known hydraulic-mechanical coal mining combines are: lack of devices which permit increasing the water pressure up to a level providing effective crushing of coal beds in the combine itself; wear of the nozzle and its frequent replacement on the monitor barrel during the change-over from high pressure water to medium pressure water, which is necessary for the work of the actuator; low reliability of the throttle device using recycled water containing hard particles of coal and the rock and complexity of control of closing fittings set in the tubing for high- and medium-pressure water supply.

In connection with the development of hydraulic technology of coal mining as the most promising one and economically useful, it became necessary to improve hydraulic-mechanical coal mining combines in order to raise their working capacity during coal mining with the help of a water jet of a medium-pressure water supply, reduce coal losses in mines and improve safety of conducting works in faces. However, there are no hydraulic-mechanical coal mining combines meeting these requirements.

It is the principle object of this invention to develop a hydraulic-mechanical coal mining combine which would increase the working capacity of coal mining as a result of the increase of energy of the hydraulic crushing of the coal bed.

Another important object of this invention is to increase the combine's efficiency.

Still another object of this invention is reduction of losses of coal in mines and also improvement of safety of conducting works in the face.

These objects are achieved by creating a hydraulic-mechanical coal mining combine comprising a crawler carriage with a driving mechanism bearing electric and hydraulic devices for controlling the combine, a supporting plate with a turntable to which an actuator with a motor for rotating a bit, and hydraulic cylinders, used for moving a hollow body of the said actuator, are hinged, the hollow body containing a built-in monitor provided with hydraulic cylinders, for moving the barrel of the said monitor in vertical and horizontal directions relative to the actuator, and manifolds with link connections for supplying water to said monitor and to said actuator, in which, according to this invention, a channel made in the supporting plate, said channel being essentially a hydraulic shock acceleration tubing whose sections are located one above another in at least two rows, and a pneumohydraulic accumulator, communication with a water supply source, connected to said channel's inlet section and an oscillator, included in the network for water supplying to the monitor, connected to its outlet.

Providing the coal mining combine with the channel made in the supporting plate, which is essentially a hydraulic shock acceleration tubing, permits, after introducing slight changes in the combine design without an appreciable increase of its size, but, only providing it with the oscillator and pneumohydraulic accumulator, to the creation of a pulse flow of high-pressure water directed via the monitor's barrel to the face while the combine itself is being supplied with water under a pressure 2–3 times lower than that of the pulse flow.

An increase in the energy of hydraulic crushing of the coal bed raises the combine's efficiency, avoids the supply of high-pressure water to the combine and permits the use for the combine's water supply of flexible hoses connected to the mine water mains. Providing coal mining combine with a channel made in the supporting plate is simple to construct and is reliable in operation.

For a better understanding of the invention, given below is a description of an embodiment of the combine with reference to the accompanying drawings in which.

Figure 1:
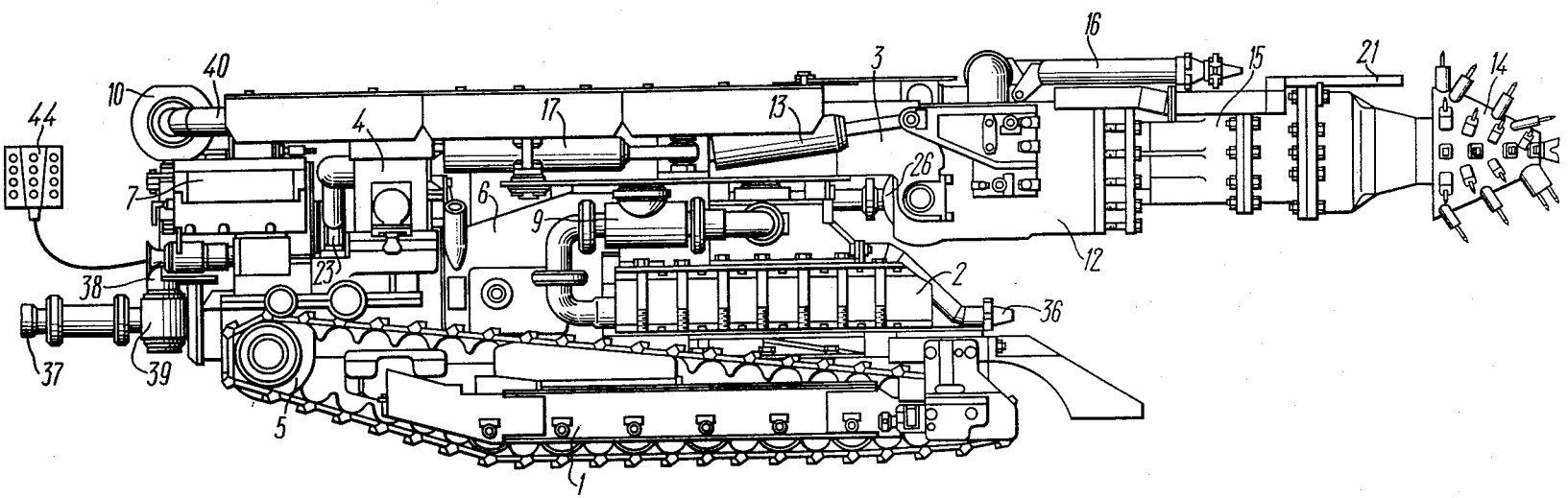
FIG. 1 is a side elevational view of a combine according to the invention.

The hydraulic-mechanical coal mining combine has a crawler carriage 1 (FIG. 1) to which by means of bolted connections a supporting plate 2 of a turntable 3, drives 4 for transmitting rotation to drive sprockets 5 of the crawler carriage 1 and hydraulic devices 6 (hereinafter refered to as "oil station" and including pump and tank for hydraulic oil) are fixed.

A housing 7 for electric apparatus for remote control of the combine is fixed to the casing of the drives 4 by means of bolted connections.

Figure 2:
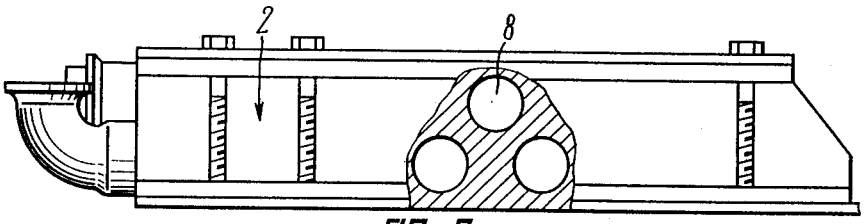
FIG. 2 is a side elevational view of the supporting plate of said combine with a cross-sectional view of a part thereof in which the turntable is shown.
Figure 3:
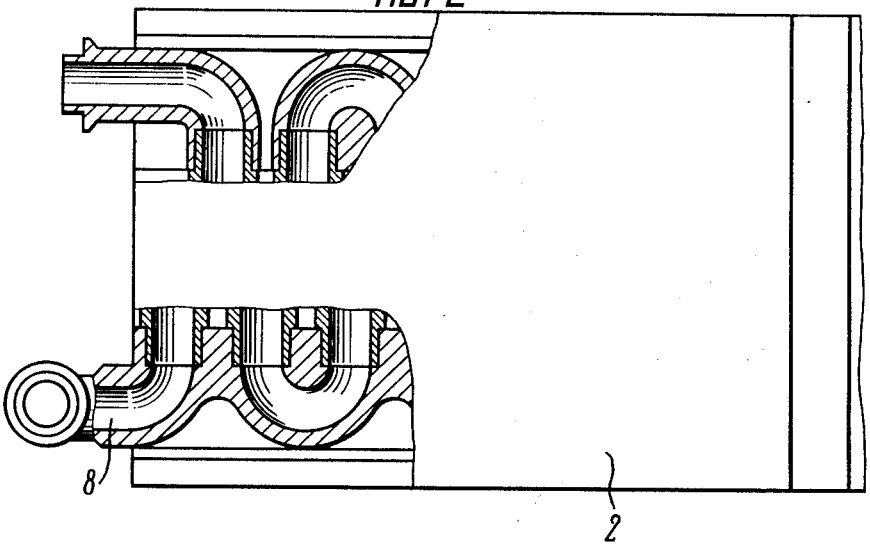
FIG. 3 is a top plan view of the same plate with a cross-sectional view of a part thereof in which the turntable is shown.

Made in the supporting plate 2 are channels 8 (FIG. 2 and 3), which are essentially hydraulic-shock acceleration tubing of a hydraulic pulser said pulses comprising an oscillator 9 (FIG. 1), fixed to the supporting plate 2, and a pneumohydraulic accumulator 10, fixed to the housing 7 for electric apparatus for remote control of the combine.

Figure 4:
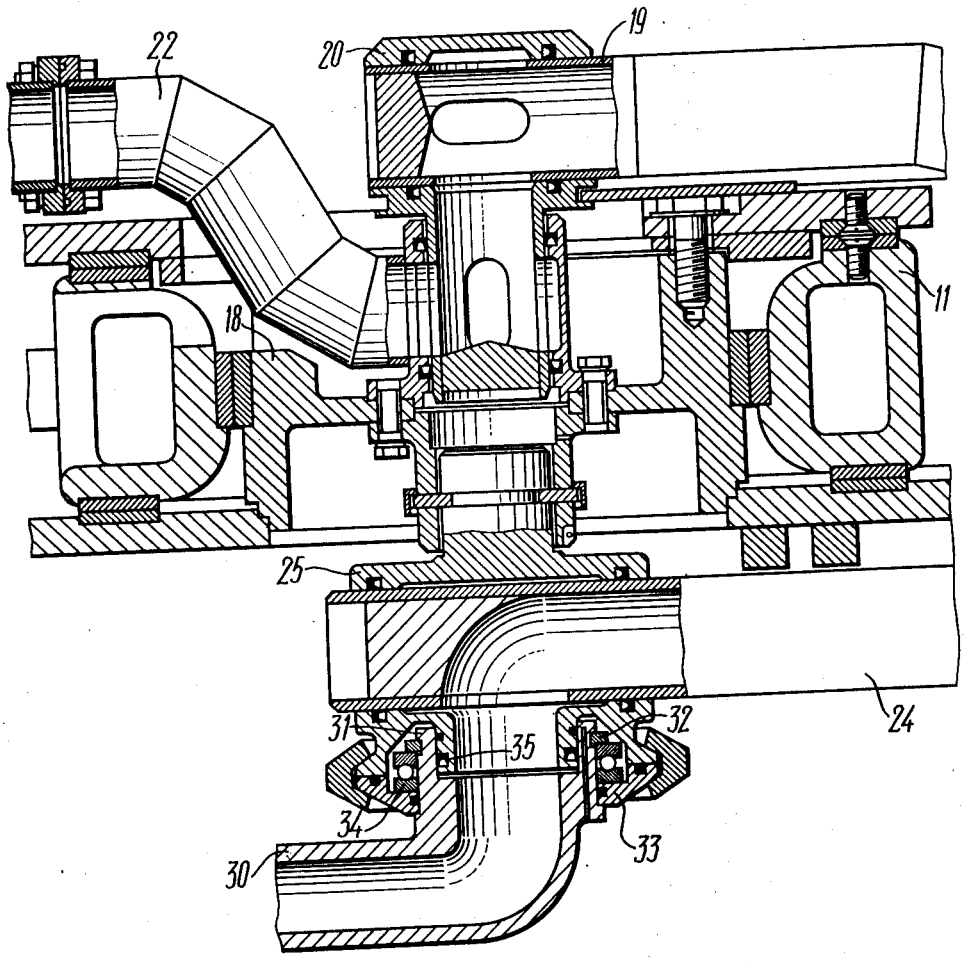
FIG. 4 is an elevational view partially in section of the turntable of the combine with link-connected manifolds for water supply to the monitor and to the actuator.

To a movable part 11 (FIG. 4) of the turntable 3 (FIG. 1) an actuator 12 of the combine; hydraulic cylinders 13 for moving in a vertical direction the actuator 12, a bit 14 having a motor 15 for its rotation and a monitor 16 are hinged. Hydraulic cylinders 17 for moving the movable part 11 (FIG. 4) of the turntable 3 (FIG. 1) in a vertical direction together with the actuator 12 of the combine are hinged to a fixed part 18 (FIG. 4) of the turn table 3 (FIG. 1).

A manifold 19 (FIG. 4), used for supplying medium-pressure water to the actuator 12, is located in the fixed part 18 (FIG. 4) of the turntable 3 (FIG. 1). One end of the manifold 19 is telescopically connected to a turning head 20, in order to allow axial movement, while the other end of the said manifold 19 is connected to a manifold 21 (FIG. 1). when an explosion-proof hydraulic turbine is used as a drive for the actuator 12, the second end of the manifold 19 will be connected to the inlet manifold of said hydraulic turbine. A flow-through channel of the turning head 20 (FIG. 4) is connected to a manifold 22 through which medium-pressure water is supplied from a block of slides 23 (FIG. 1).

High-pressure water from the oscillator 9 to the monitor 16 is supplied through a manifold 24 (FIG. 4), one end of said manifold is connected to a turning head 25, provided in the fixed part 18 of the turntable 3 (FIG. 1), while the other end of said manifold is connected to a two-channel hinge 26 (FIG. 1), whose flow-through channels are connected via a stand pipe 27 (FIG. 5), a carrier 28 and a connecting pipe 29 bent at an angle of 90° to the barrel of the monitor 16 (FIG. 1).

Turning heads 20 (FIG. 4) and 25 are set in the fixed part 18 of the turntable 3 (FIG. 1) in such a manner that their axes of rotation coincide with the geometrical axis of rotation of the turntable.

The pulse flows of the high-pressure water is branched from the oscillator 9 to the turning head 25 (FIG. 4) by means of a manifold 30, which ends with a bucket 31. A bearing 34 is set in the bucket 31 with the help of a sliding block 32 and a locking connection 33. The interior space of the bucket 31 interacts with a sealing element 35 located in a groove of the turning head 25. Supplying of pulse flow of low-pressure water from the oscillator 9 (FIG. 1) to the face is implemented via a nozzle 36 fixed in the supporting plate 2.

Supplying of water from a flexible hose 37 to the block of slides 23 is implemented via a manifold 38, whose outlet is built into a turning head 39, while branching of water from the block of slides 23 to the hydraulic-shock acceleration tubing 8 (FIGS. 2 and 3), made in the supporting plate 2, is implemented through a manifold 40 (FIG. 1) via the pneumohydraulic accumulator 10.

Located in the hollow body 41 (FIG. 5) of the actuator 12 (FIG. 1) is the standpipe 27 (FIG. 5) of the monitor 16. The carrier 28 and connecting pipe 29, bent at an angle of 90°, are provided on the standpipe 27.

A hydraulic cylinder 42 for moving the barrel of the monitor 16 in a vertical direction is suspended from the connecting pipe 29. A hydraulic cylinder 43 for moving the barrel of the monitor 16 in a horizontal direction is fixed in lugs, made in the side wall of the hollow body 41 of the actuator 12 (FIG. 1), and is linked to the connecting pipe 29 (FIG. 5) with the help of the carrier 28.

A remote control station 44, located at a distance of 20 m from the combine, is provided for remote control of the crawler carriage 1 (FIG. 1), the actuator 12, the monitor 16 and hydraulic apparatuses (oil station).

A plug cock (not shown), operated manually, is provided for starting the hydraulic pulser of the combine.

The coal mining combine operates as follows.

The motor of the oil station 6 (FIG. 1) is started with the help of the remote-control station 44. The slide of the mine water main is then opened and medium-pressure water via flexible hose 38 is supplied to the combine. Depending on the face working conditions, water can be supplied either to the actuator 12 for hydraulic transportation of coal from the face, cooling of the bit 14, and dust depression in the face, or to the monitor 16; and when the hydraulic turbine is used as a drive instead of the electric drive, water is supplied to the turbine drive.

For coal mining from development workings, the motor of the actuator 12 is switched on from the remote control station 44, and then the block of the slides 23 is opened by means of the same remote control station and water flows via the manifold 22 (FIG. 4), the turning head 20, the manifold 19 and the two-channel hinge 25 to the manifold 21 (FIG. 1) of the actuator 12. The motors of the crawler carriage 1 are then switched on and the combine drives the face a distance equal to the size of the bit 14. In this case, face working is accomplished moving by the actuator 12 in vertical and horizontal directions within the face by using hydraulic cylinders 13 and 14.

Figure 5:
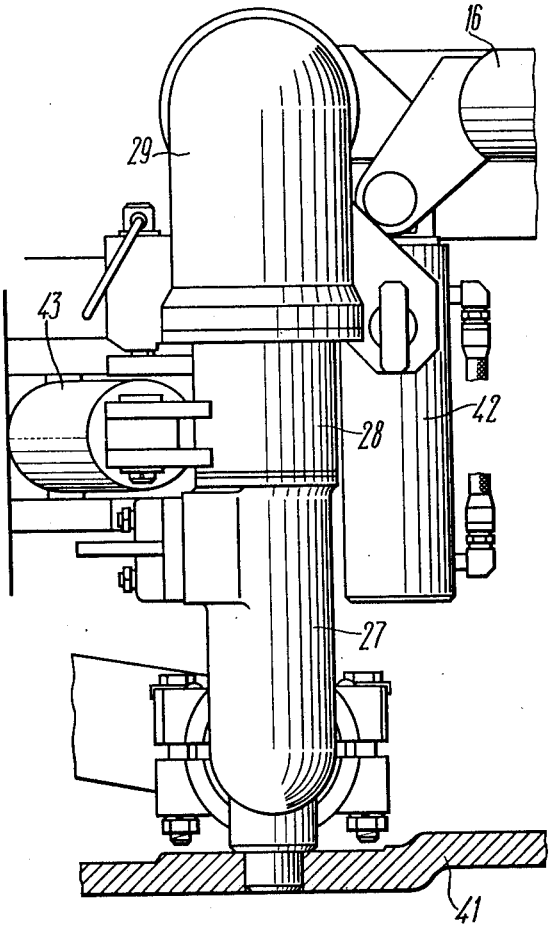
FIG. 5 is an elevational view of the monitor contained in the hollow body of the actuator.

Coal mining from technological pillars and upper blocks of untouched ore is accomplished with the help of a pulse high-pressure water jet of the monitor. To this purpose the block of slides 23 is switched and medium-pressure water via the pneumohydraulic accumulator 10, the manifold 40 and the channel 8 (FIGS. 2 and 3) of the hydraulic shock acceleration tubing, made in the supporting plate 2, flows to the oscillator 9 (FIG. 1), wherein a rise of pressure and a creation of hydraulic shocks by means of regular changes of the system's hydraulic resistance is achieved. The pulse high-pressure water flow via the manifold 30 (FIG. 4), the turning head 25, the manifold 24, the two-channel hinge 26 (FIG. 1), the standpipe 27 (FIG. 5), the carrier 28 and the connecting pipe 29 is directed to the barrel of the monitor 16, wherein a water jet is formed. The pulse low-pressure water flow from the oscillator 9 (FIG. 1) flows to the face via the manifold with the nozzle 30. Moving the barrel of the monitor 16 for coal mining in this case, is accomplished by hydraulic cylinders 42 and 43 (FIG. 5).

If in the hollow body of the actuator 12 (FIG. 1) the monitor 16, provided with hydraulic cylinders for moving its barrel in vertical and horizontal directions, is set, the width of the coal mined from the face and the portion of a high-productive coal mined using the monitor are increased.

When recycled water is used for supplying the combine, a primary filter can be introduced the water supply system. The width of such a filter's openings should be not more than 3 mm. This eliminates the possibility of hard particles getting into the water supply system of the combine and, thus, increases its operational reliability.

After completing the mining of coal from the upper blocks of the untouched ore and the technologicl pillars, the combine is withdrawn a timbered shaft and its working cycle is completed.

An experimental prototype of the hydraulic-mechanical coal mining combine in accordance with the invention has passed industrial tests and has shown a working capacity 25-30 per cent higher than that of the well known coal mining combines.

Technical documentation for the combine prototypes according to this invention is elaborated at present.

What is claimed is:

1. A hydraulic-mechanical coal mining combine comprising: a crawler carriage; a drive for moving said crawler carriage mounted in said crawler carriage; electric and hydraulic apparatus for the combine control mounted in said crawler carriage; a supporting bed plate fixed in said crawler carriage and having a bed plate channel, said channel being essentially a hydraulic shock acceleration tubing, said channel being bent in such a manner that its sections are located one above another in at least two rows, said channel having an inlet and an outlet; a turntable fixed in said crawler carriage and resting on said supporting bed plate; an actuator of said combine having a bit and hollow body, hinged to said turntable; a motor for rotation of said bit mounted in said turntable; hydraulic cylinders for moving said actuator in vertical and horizontal directions hinged to said turntable; a monitor having a barrel hinged to a standpipe, said standpipe being built in the hollow body of said actuator; hydraulic cylinders hinged to said standpipe and to said hollow body of said actuator for moving the barrel of said monitor in vertical and horizontal directions; a manifold fixed to said crawler carriage, said turntable and said actuator and communicting with a water supply source for supplying water to said actuator; a pneumohydraulic accumulator connected to the inlet of said channel and to the water supply source, said accumulator being made in said supporting bed plate and being set on said crawler carriage; and an oscillator located on said supporting bed plate and connected to the outlet of said channel and included in the water supply network of said monitor.

* * * * *